US006727647B2

(12) United States Patent
Fukuda et al.

(10) Patent No.: US 6,727,647 B2
(45) Date of Patent: Apr. 27, 2004

(54) ELECTROLUMINESCENT LIGHT-EMITTING DEVICE

(75) Inventors: Shinsaku Fukuda, Kasugai (JP); Masaharu Ono, Ueno (JP); Naoyuki Mori, Ueno (JP); Takayuki Hora, Ueno (JP)

(73) Assignees: Print Labo Co., Ltd., Kasugai (JP); Nippon Electroluminescent Light Co., Ltd., Ueno (JP)

( * ) Notice: Subject to any disclaimer, the term of this patent is extended or adjusted under 35 U.S.C. 154(b) by 0 days.

(21) Appl. No.: 10/300,842

(22) Filed: Nov. 21, 2002

(65) Prior Publication Data

US 2003/0197461 A1 Oct. 23, 2003

(30) Foreign Application Priority Data

Apr. 19, 2002 (JP) ..... 2002-118071

(51) Int. Cl.[7] ..... H05B 33/00

(52) U.S. Cl. ..... 313/506; 313/509; 313/113; 428/917

(58) Field of Search ..... 313/502, 505, 313/506, 509, 113; 428/917

(56) References Cited

U.S. PATENT DOCUMENTS 5,712,528 A * 1/1998 Barrow et al. ..... 313/509
5,841,230 A * 11/1998 Ikoma et al. ..... 313/506
6,133,693 A * 10/2000 Keyser ..... 313/506
6,384,529 B2 * 5/2002 Tang et al. ..... 313/506
6,479,930 B1 * 11/2002 Tanabe et al. ..... 313/509
6,541,790 B1 * 4/2003 Pichler ..... 257/40

FOREIGN PATENT DOCUMENTS

JP U 3034483 11/1996

* cited by examiner

*Primary Examiner*—Ashok Patel
(74) *Attorney, Agent, or Firm*—Oliff & Berridge, PLC

(57) ABSTRACT

An electroluminescent light-emitting device having a light-emitting surface area and including (a) an electroluminescent light-emitting layer containing an electroluminescent material, and (b) an electrode layer formed on one of opposite sides of the electroluminescent light-emitting layer and including a first electrode and a second electrode which are formed in respective predetermined patterns such that the two electrodes are spaced apart from each other by spacing regions provided therebetween, in a direction parallel to a plane of the electrode layer, and such that the two electrodes are electrically insulated from each other by the spacing regions. The electroluminescent light-emitting device has an exposed surface which is located on the other side of the electroluminescent light-emitting layer and to which an electrically conductive ink is applicable.

15 Claims, 2 Drawing Sheets

ELECTROLUMINESCENT LIGHT-EMITTING DEVICE

This application is based on Japanese Patent Application No. 2002-118071 filed on Apr. 19, 2002, the contents of which are incorporated hereinto by reference.

BACKGROUND OF THE INVENTION

1. Field of the Invention

The present invention relates in general to an electroluminescent light-emitting device, and more particularly to an electroluminescent light-emitting device which is suitably used as an interior or exterior decorative or ornamental article, a signboard lighting device or toys, and which is arranged to emit a pattern of light which is desired by the user and which is defined by an electrically conductive ink that is applied by the user to the device in a pattern corresponding to the desired pattern of light.

2. Discussion of Related Art

There is known an electroluminescent (EL) light-emitting device including an electroluminescent light-emitting layer containing a suitable electroluminescent material, a front transparent electrode layer and a back electrode layer which are disposed on respective opposite sides of the light-emitting layer, so as to sandwich the light-emitting layer in the direction of thickness of the layers. By applying an AC voltage between the front and back electrodes, a local portion of the light-emitting layer is energized to emit a pattern of light which corresponds to a pattern in which the back electrode is formed. An example of the electroluminescent light-emitting device of this type is disclosed in JP-U-3034483. The light-emitting device disclosed in this publication takes the form of a thin plate, and is usable for various purposes, for instance, as a backlight device for a light-emitting display panel or decorative board.

In an electroluminescent light-emitting device as described above, a masking layer having a light-transmitting portion may be superposed on the front surface of the device over its entire area, so that the pattern of light emission from the device is defined by the light-transmitting portion. However, this device suffers from difficulty to change the pattern of light emission as desired by the user, and difficulty to prepare a mask having a shaded or half-tone portion. Thus, the conventional electroluminescent light-emitting device tends to suffer from a low degree of freedom in the pattern of light emission.

On the other hand, it has been proposed to form the back electrode in a desired pattern by applying a paste of an electrically conductive material by screen printing, for example. However, a screen or stencil for forming the back electrode is not easy and economical for the user of the device to manufacture.

SUMMARY OF THE INVENTION

The present invention was made in the light of the background art discussed above. It is therefore an object of the present invention to provide an electroluminescent light-emitting device which permits the user to change a pattern of light emission as desired in a simple manner.

The object indicated above may be achieved according to the principle of the present invention, which provides an electroluminescent light-emitting device having a light-emitting surface area, the device comprising: (a) an electroluminescent light-emitting layer containing an electroluminescent material; and (b) an electrode layer formed on one of opposite sides of the electroluminescent light-emitting layer, and including a first electrode and a second electrode which are formed in respective predetermined patterns and spaced apart from each other by spacing regions provided therebetween, in a direction parallel to a plane of the electrode layer, the first and second electrodes being electrically insulated from each other by the spacing regions, the electroluminescent light-emitting device having an exposed surface which is located on the other of the opposite sides of the electroluminescent light-emitting layer and to which an electrically conductive ink is applicable.

In the electroluminescent light-emitting device of the present invention constructed as described above, the electrically conductive ink is applied to the exposed surface of the device located on the side of the electroluminescent light-emitting layer remote from the electrode layer, while an AC voltage is applied between the first and second electrodes, so that there arises a flow of an alternating electric current between the first and second electrodes through the electrically conductive ink, whereby a local portion of the electroluminescent light-emitting layer which is located right below the applied electrically conductive ink emits light in a pattern formed by the ink in the light-emitting surface area of the exposed surface. Thus, the pattern of emission of light from the present electroluminescent light-emitting device can be easily formed and changed as desired, by the user of the electroluminescent light-emitting device.

According to one preferred form of this invention, the electroluminescent light-emitting device further comprises a top coating which covers one of opposite surfaces of the electroluminescent light-emitting layer which is remote from the electrode layer, the top coating having the exposed surface to which the electrically conductive ink is applicable.

In the electroluminescent light-emitting device according to the above-indicated preferred form of this invention, the user of the device applies the electrically conductive ink to the exposed surface of the top coating covering the electroluminescent light-emitting layer, while the AC voltage is applied between the first and second electrodes. The top coating is effective to protect the light-emitting layer, prevent permeation of the electrically conductive ink into the light-emitting layer, and facilitate the removal of the ink from the device when the ink is applied in a new pattern, for instance.

According to a first advantageous arrangement of the above-indicated preferred form of the invention, a surface area of the spacing regions of the electrode layer per unit area of the light-emitting surface area of the device is substantially constant throughout the light-emitting surface area. This arrangement assures a constant or uniform intensity of light emitted by the local portion of the electroluminescent light-emitting layer located right below the electrically conductive ink, irrespective of the location of this local portion (location of the ink), throughout the light-emitting surface area of the device. In other words, the present arrangement prevents a variation in the intensity of light emission from the electroluminescent light-emitting layer, which variation depends upon the specific location of the electrically conductive ink in the light-emitting surface area.

According to a second advantageous arrangement of the above-indicated preferred form of the invention, the electroluminescent light-emitting layer has a thickness within a range from 20 $\mu$m to 50 $\mu$m. This light-emitting layer assures a sufficiently high intensity of light emission. If the thickness is smaller than 20 μm, the intensity of the electric field produced by the electroluminescent material is increased, but a mass of the electroluminescent material which emits light upon application of the voltage to the device is reduced. If the thickness is larger than 50 μm, on the other hand, the above-indicated mass of the electroluminescent material is increased, but the intensity of the electric field produced by the electroluminescent material is reduced. Accordingly, the intensity of light emission is comparatively low where the thickness of the electroluminescent light-emitting layer is outside the range indicated above.

According to a third advantageous arrangement of the above-indicated preferred form of the invention, the electroluminescent light-emitting device a further comprises an electrically insulating reflecting layer which is interposed between the electroluminescent light-emitting layer and the electrode layer, to reflect light emitted by the electroluminescent light-emitting layer, back toward the light-emitting layer and the exposed surface of the top coating. In this arrangement, the light emitted by the light-emitting layer is reflected by the electrically insulating reflecting layer, back toward the light-emitting layer, thereby increasing the light-emitting efficiency of the present electroluminescent light-emitting device and the intensity of light emission from the device.

In the above-indicated third advantageous arrangement, the electrically insulating reflecting layer may be formed of a mixture of a power of a ferroelectric material and a resin binder in which the powder is dispersed. This reflecting layer appears substantially white, effectively functioning to reflect the light from the electroluminescent light-emitting layer, so that the intensity of light emission from the device is further increased. In addition, the use of the ferroelectric material having a high dielectric constant enables the reflecting layer to exhibit a sufficiently high dielectric constant, so that the intensity of the electric field produced by the electroluminescent material of the light-emitting layer is not significantly reduced by the electrically insulating reflecting layer interposed between the light-emitting layer and the electrode layer. Barium titanate or Rochelle salt may be used as the ferroelectric material.

In the above-indicated third advantageous arrangement, the electrically insulating reflecting layer may have a dielectric constant within a range of 30–100, preferably, 60–100. In this case, the reflecting layers interposed between the light-emitting layer and the electrode layer does not significantly reduce the intensity of the electric field of the light-emitting layer. It is noted that a material which gives the electrically insulating reflecting layer a dielectric constant exceeding 100 is expensive.

According to a fourth advantageous arrangement of the above-indicated preferred form of this invention, the top coating is formed of a synthetic resin capable of preventing permeation of the electrically conductive ink into the electroluminescent light-emitting layer. For example, the resin material of the top coating is selected so as to give the top coating a smooth surface for easy deposition and removal of the electrically conductive ink, and a high degree of resistance to permeation of the electrically conductive ink into the electroluminescent light-emitting layer. For instance, the resin material for the top coating is selected from among: tetrafluorinated ethylene; fluorine-containing synthetic resin such as fluoro-rubber; silicon resin such as silicon rubber; and polyester resin. In particular, the use of a fluorine-containing synthetic resin is advantageous for comparatively easy removal of the electrically conductive ink by wiping the surface top coating.

Preferably, the electrically conductive ink as applied to the top coating has a surface electrical resistance of not higher than $10^6$ Ω/□, and a relatively high degree of light transmittance. For instance, the electrically conductive ink consists of a mixture of a power of at least one electrically conductive material selected from among indium oxide, tin oxide, antimony and zinc oxide, and a solvent in which the powder is dispersed. This ink is effective to locally energize the electroluminescent light-emitting layer so as to emit light.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Figure 1:
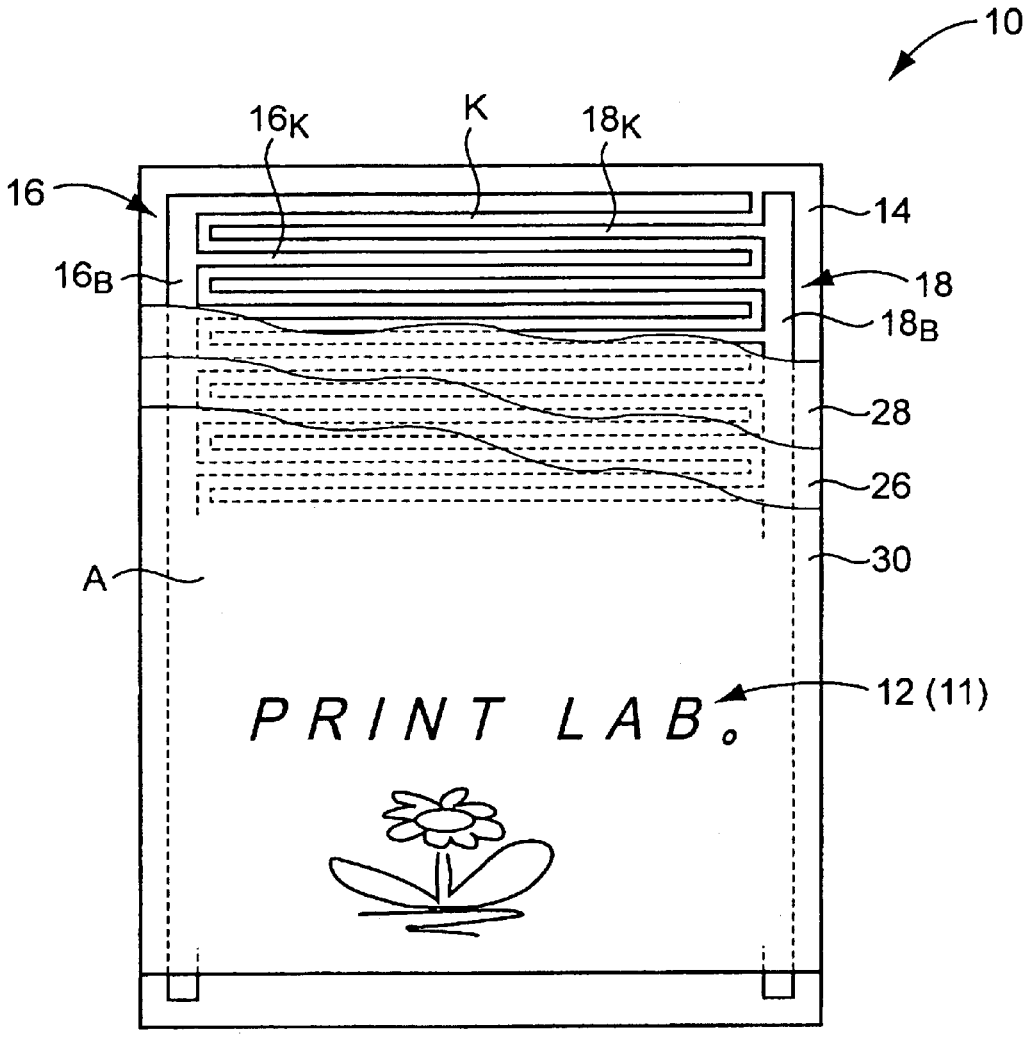
FIG. 1 is a partly cut-away front view of an electroluminescent light-emitting device constructed according to one embodiment of this invention.
Figure 2:
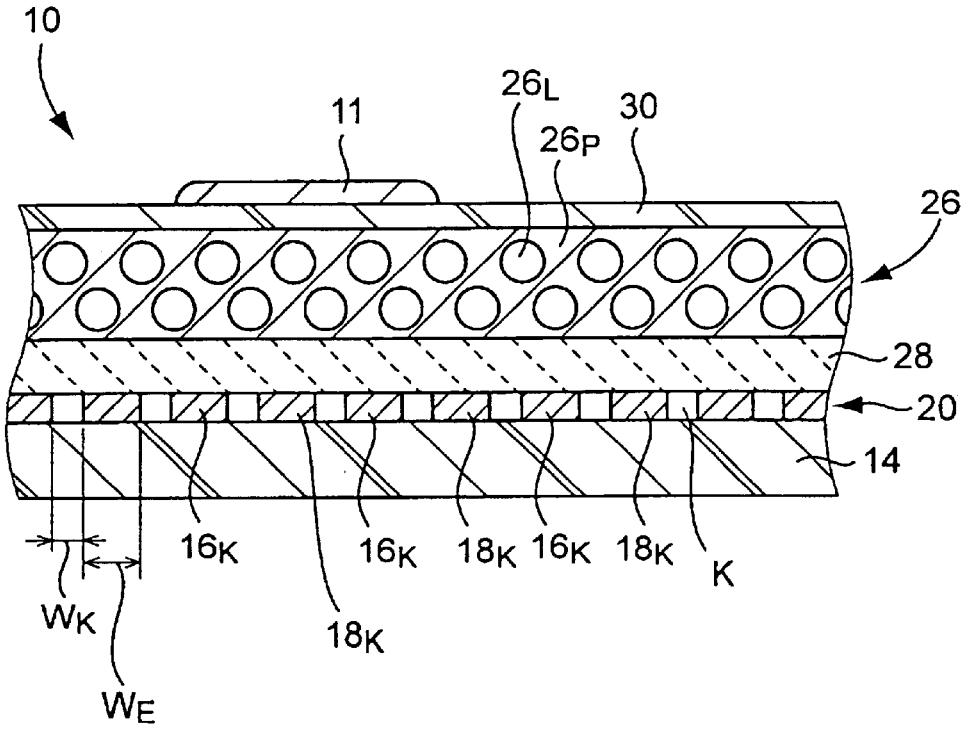
FIG. 2 is a fragmentary enlarged view showing a part of the electroluminescent light-emitting device of FIG. 1 in cross section taken in a plane which is parallel to a direction of thickness and a longitudinal direction of the device.

Referring to the front view of FIG. 1 and the fragmentary enlarged cross sectional view of FIG. 2, there is shown an electroluminescent light-emitting device 10 in the form of a thin plate constructed according to one embodiment of the present invention. This electroluminescent light-emitting device 10 (hereinafter referred to as "EL light-emitting device 10") has a light-emitting pattern 12 formed by an electrically conductive ink 11 applied to its front surface. The ink 11 is applied to the front surface by the user of the EL light-emitting device 10 either manually or by using a printer. The EL light-emitting device 10 is operated to emit light in the light-emitting pattern 12 formed locally on the EL light-emitting device 10, as described below in detail.

The EL light-emitting device 10 is a generally rectangular plate the front surface of which has a substantially rectangular light-emitting surface area A, as shown in FIG. 1. The EL light-emitting device 10 includes: a transparent or opaque, flexible substrate sheet 14 formed of a synthetic resin such as polyethylene terephthalate (PET); an electrode layer 20 consisting of a pair of electrodes, namely, a first electrode 16 and a second electrode 18 which are formed on one surface of the substrate sheet 14; an electroluminescent light-emitting layer 26 (hereinafter referred to as "EL light-emitting layer 26") containing an electroluminescent material in the form of a multiplicity of electroluminescent light-emitting elements $\mathbf{26}_L$ embedded in a mass of a synthetic resin $\mathbf{26}_P$; an electrically insulating reflecting layer 28 interposed between the electrode layer 20 and the EL light-emitting layer 26; and a top coating 30 formed on one of opposite surfaces of the EL light-emitting layer 26 which is remote from the electrically insulating layer 28. The top coating 30 is formed of a resin, and provides the above-indicated front surface of the EL light-emitting device 10 on which the light-emitting pattern 12 is formed of the electrically conductive ink 11. The EL light-emitting device 10 is a laminar structure consisting of the above-indicated substrate sheet 14, electrode layer 20, electrically insulating reflecting layer 28, EL light-emitting layer 26 and top coating 20, which are superposed on each other and bonded together with a suitable adhesive or bonding agent.

The first and second electrodes 16, 18 of the electrode layer 20 are formed on the substrate sheet 14 in a comb-like pattern by screen printing, using a paste of a suitable electrically conductive material such silver or copper, namely, a paste including a power of such an electrically conductive material. The paste of the electrically conductive material applied to the substrate sheet 14 is subjected to a heat treatment, so that the electrodes 16, 18 in the form of combs are fixedly formed on the substrate sheet 14. The first and second electrodes 16, 18 are located relatively close to each other, and are electrically insulated from each other with spacing regions K provided therebetween, as indicated in FIG. 2 and as described below in detail. A surface area of the spacing regions K per unit area of the light-emitting surface area A is substantially constant throughout the light-emitting surface area A. Described in detail, the first electrode 16 consists of an elongate base portion $\mathbf{16}_B$ formed along one of two long sides of a rectangle of the front surface of the EL light-emitting device 10, and a teeth portion $\mathbf{16}_K$ consisting of a multiplicity of mutually parallel teeth which extend from the base portion $\mathbf{16}_B$ toward the other long side (right side as seen in FIG. 1) of the rectangle such that the teeth are equally spaced apart from each other in the direction parallel to the long sides. The second electrode 18 consists of an elongate base portion $\mathbf{18}_B$ formed along the above-indicated other long side, and a teeth portion $\mathbf{18}_K$ consisting of a multiplicity of mutually parallel teeth which extend from the base portion $\mathbf{18}_B$ toward the other long side of the rectangle such that the teeth of the teeth portion $\mathbf{18}_K$ are equally spaced apart from each other in the direction parallel to the long sides and such that each of the teeth of the teeth portion $\mathbf{18}_K$ of the second electrode 18 is interposed between the adjacent teeth of the teeth portion $\mathbf{16}_K$ of the first electrode 16, as shown in FIG. 1. One end portion (a lower end portion as seen in FIG. 1) of the base portion $\mathbf{16}_B$, $\mathbf{18}_B$ is exposed and functions as a terminal. A distance between the adjacent teeth of the teeth portions $\mathbf{16}_K$, $\mathbf{18}_K$ of the first and second electrodes 16, 18 is equal to a width dimension $W_K$ of each spacing region K indicated above, which is selected within a range of about 0.3–1.0 mm. On the other hand, a width dimension WE of each tooth of the teeth portions $\mathbf{16}_K$, $\mathbf{18}_K$ is selected within a range of about 1.0–3.0 mm. The first and second electrodes 16,18 may be formed by etching a foil or a vapor-deposited film of a metal such as copper or aluminum.

The electrically insulating reflecting layer 28 consists of a binder such as acrylic resin, and a powder of an inorganic material such as a ferroelectric material such as barium titanate or Rochelle salt, which is dispersed in the powder of the binder. The inorganic material such as ferroelectric material is a white pigment, so that the electrically insulating layer 28 appears white, and functions to effectively reflect light generated by the EL light-emitting layer 26, back toward the EL light-emitting layer 26, thereby improving the light-emitting efficiency of the EL light-emitting device 10. The reflecting layer 28 has a thickness of about 10–30 $\mu$m, and has a withstand voltage of about 200–300V, and a dielectric constant of about 30–100, preferably, about 60–100.

The electroluminescent light-emitting elements $\mathbf{26}_L$ of the EL light-emitting layer 26 described above are formed of a powder of a fluorescent material or phosphor, while the synthetic resin $\mathbf{26}_P$ serves as a transparent binder in which the electroluminescent light-emitting elements $\mathbf{26}_L$ are dispersed. Upon application of an alternating electric field to the EL light-emitting layer 26, this layer 26 emits a light of a predetermined color such as a cyanic color. The resin binder 26P is preferably a polyester resin or other resin having a high dielectric constant. The EL light-emitting layer 26 has a thickness of about 30–40 $\mu$m, and has a withstand voltage of about 50–150V, and a dielectric constant of about 10–30. Preferably, the thickness of the EL light-emitting layer 6 is at least 1.5 times the diameter of each electroluminescent light-emitting element $\mathbf{26}_L$. In this case, the EL light-emitting layer 26 has a high degree of surface smoothness, for instance, a surface roughness of not higher than 30 $\mu$m.

The top coating 30 is provided to cover one of opposite major surfaces of the EL light-emitting layer 26 which is remote from the electrically insulating layer 28, so that the top coating 30 provides the light-emitting surface area A on which the light-emitting pattern 12 of the electrically conductive ink 11 is formed. The top coating 30 has a smooth surface serving as the front surface of the EL light-emitting device 10, and prevents permeation of the electrically conductive ink 11 into the EL light-emitting layer 26. The top coating 30 is formed of a resin material which is capable of forming a smooth surface for easy deposition and removal of the electrically conductive ink 11 and which has a high degree of resistance to permeation of the electrically conductive ink 11 into the EL light-emitting layer 26. For instance, the resin for the top coating 30 is selected from among: tetrafluorinated ethylene; fluorine-containing synthetic resin such as fluoro-rubber; silicon resin such as silicon rubber; and polyester resin. In particular, the use of a fluorine-containing synthetic resin is advantageous for comparatively easy removal of the electrically conductive ink 11 by wiping the top coating 30.

The electrically conductive ink 11 as applied to the top coating 30 has a surface electrical resistance of not higher than $10^6$ Ω/□, and a relatively high degree of light transmittance, and consists of a power of at least one electrically conductive material such as indium oxide, tin oxide, antimony and zinc oxide, and a solvent in which the powder is dispersed. The electrically conductive ink 11 may be an electrically conductive polymer such as polyethylene dioxi thiophene, or a mixture of the electrically conductive polymer and a powder of the above-indicated electrically conductive material. In this case, the light-emitting pattern 12 can be illuminated for a relatively long period, unless the ink 11 is removed by wiping the surface of the top coating 30. The electrically conductive ink 11 may be constituted by an aqueous component having high electrical conductivity or a hydrophilic solvent. In this case, the ink 11 may be easily removed by drying it with a suitable drier.

Figure 3:
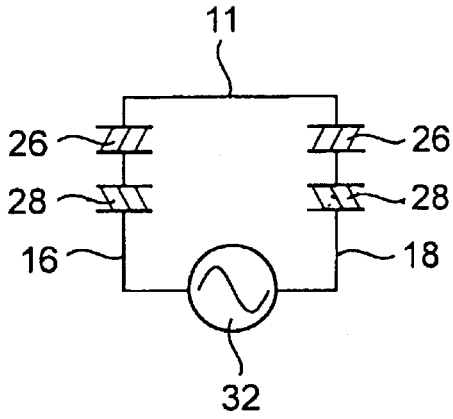
FIG. 3 is an equivalent electric circuit for explaining a principle of light-emitting operation of the electroluminescent light-emitting device of FIG. 1.

When the EL light-emitting device 10 constructed as described above is used, the electrically conductive ink 11 is applied to the light-emitting surface area A in the desired pattern, either manually by the user of the device 10, or with an ink-jet or screen printer, while an AC voltage is applied from an AC power source 32, between the exposed terminal end portions of the base portions $\mathbf{16}_B$, $\mathbf{18}_B$ of the first and second electrodes 16, 18, so that an alternating current flows between the first and second electrodes 16, 18 through the electrically conductive ink 11, whereby an alternating electric field is locally produced in a portion of the EL light-emitting layer 26 which is located right below the electrically conductive ink 11. As a result, that portion of the EL light-emitting layer 26 emits light. Described more specifically, the EL light-emitting layer 26 and the electrically insulating reflecting layer 28 have high dielectric constants, so that a closed circuit is formed by the first electrode 26, a part of the electrically insulating reflecting layer 28, a part of the EL light-emitting layer 26, the electrically conductive ink 11, another part of the EL light-emitting layer 26, another part of the electrically insulating reflecting layer 28 and the second electrode 18, as indicated in FIG. 3, such that the closed circuit has a shortest distance of loop passing the electrically conductive ink 11. The portion of the EL light-emitting layer 26 which partially defines this closed circuit and which is located right below the electrically conductive ink 11 is activated to emit light in a pattern corresponding to the light-emitting pattern 12 formed of the ink 11. In the other portion of the EL light-emitting layer 26 which is not located right below the electrically conductive ink 11, the intensity of the electric field is not high enough to enable that portion to emit light, since the thickness values and the dielectric constants of the electrically insulating reflecting layer 28 and the EL light-emitting layer 26 are so determined.

As described above, the electrically conductive ink 11 is applied to the exposed surface of the top coating 30 covering the EL light-emitting layer 26, while the AC voltage is applied between the first and second electrodes 16, 18, so that there arises a flow of an alternating electric current between the first and second electrodes 16, 18 through the electrically conductive ink 11, and the local portion of the EL light-emitting layer 26 located right below the ink 11 emits light in the pattern 12 formed by the ink 11 in the light-emitting surface area A on the exposed front surface of the EL light-emitting device 10. Thus, the pattern 12 of emission of light from the present light-emitting device 10 can be easily formed and changed as desired, by the user of the device 10.

In addition, the first and second electrodes 16, 18 of the electrode layer 20 are formed, such that the surface area of the spacing regions K per unit area of the light-emitting surface area A is substantially constant throughout the light-emitting surface area A, as described above. This arrangement assures a constant or uniform intensity of light emitted by the local portion of the EL light-emitting layer 26 located right below the electrically conductive ink 11, irrespective of the location of this local portion (location of the ink 11), throughout the light-emitting surface area A. In other words, the present arrangement prevents a variation in the intensity of light emission from the EL light-emitting layer 26, depending upon the specific location of the electrically conductive ink 11 in the light-emitting surface area A. Further, the intensity of light emission can be held constant throughout the light-emitting surface area A, owing to the dimensioning of the first and second electrodes 16, 18 such that the width dimension WK of the spacing regions K provided between the adjacent teeth of the teeth portions $\mathbf{16}_K$ and $\mathbf{18}_K$ is selected to be relatively small within a range from about 0.3 mm and about 1.0 mm, while the width dimension $W_E$ of each tooth of the teeth portions $\mathbf{16}_K$, $\mathbf{18}_K$ is selected to be relatively large within a range from about 1.0 mm to about 3.0 mm, as described above.

Further, the EL light-emitting layer 26 the thickness of which is selected within a range from 20 $\mu$m to 50 $\mu$m assures a sufficiently high intensity of light emission. If the thickness is smaller than 20 $\mu$m, the intensity of the electric field produced by the electroluminescent light-emitting elements $\mathbf{26}_L$ is increased, but the number of the elements $\mathbf{26}_L$ which emits light is reduced. If the thickness is larger than 50 $\mu$m, on the other hand, the number of the elements $\mathbf{26}_L$ emitting limit is increased, but the intensity of the electric field produced by the elements $\mathbf{26}_L$ is reduced. Accordingly, the intensity of light emission is comparatively low where the thickness of the layer 26 is outside the range indicated above.

In the present embodiment wherein the electrically insulating reflecting layer 28 is interposed between the EL light-emitting layer 26 and the electrode layer 20, the light emitted by the layer 26 is reflected by the reflecting layer 28, back toward the layer 26, thereby increasing the light-emitting efficiency of the EL light-emitting device 10 and the intensity of light emission from the device 10.

Further, the electrically insulating reflecting layer 28 formed of a mixture of a power of a ferroelctric material and a resin binder in which the powder is dispersed appears substantially white, effectively functioning to reflect the light from the EL light-emitting layer 26, so that the intensity of light emission from the device 10 is further increased. In addition, the use of the ferroelectric material having a high dielectric constant enables the reflecting layer 28 to exhibit a sufficiently high dielectric constant, so that the intensity of the electric field produced by the electroluminescent light-emitting elements $\mathbf{26}_L$ is not significantly reduced by the electrically insulating reflecting layer 28 interposed between the light-emitting layer 26 and the electrode layer 20.

Described more specifically, the dielectric constant of the electrically insulating reflecting layer 28 is held within a range of 30–100, preferably, 60–100, so that the reflecting layers 28 interposed between the layers 26, 20 does not significantly reduce the intensity of the electric field of the EL light-emitting layer 26.

The present light-emitting device 10 is further arranged such that the EL light-emitting layer 26 is covered by the top coating 30 formed of a synthetic resin capable of preventing permeation of the electrically conductive ink 11 into the layer 26. Further, the electrically insulating ink 11 can be easily removed from the top coating 30 by wiping the surface of the top coating 30, so that the present EL light-emitting device 10 can be repeatedly used.

In the present EL light-emitting device 10 wherein the electrically conductive ink 11 as applied to the top coating 30 has a surface electrical resistance of not higher than $10^6$ Ω/□, and a relatively high degree of light transmittance, the ink 11 forms a part of the closed circuit connecting the first and second electrodes 16, 18, so that the EL light-emitting layer 26 can be locally energized to emit light.

While one preferred embodiment of this invention has been described above, it is to be understood that the present invention may be otherwise embodied.

In the EL light-emitting device 10 according to the illustrated embodiment of the invention, the electrically insulating reflecting layer 28 is interposed between the electrode layer 20 and the EL light-emitting layer 26, for the purpose of increasing the light-emitting efficiency of the device 10 by reflecting the light emitted by the layer 26. However, the reflecting layer 28 is not essential. The top coating 30, which is formed on the EL light-emitting layer 26 for the purpose of protecting the layer 26, preventing permeation of the electrically conductive ink 11 into the layer 26 and facilitating the removal of the ink 11, is not essential.

In the illustrated embodiment, the first and second electrodes 16, 18 are formed by using a paste of an electrically conductive material, these electrodes may be formed by using a mixture of a powder of a carbon and a resin binder, or may be films formed by deposition of a metallic material, such as films of ITO (indium tin oxide). Where the first and second electrodes 16, 18 consist of transparent layers formed of ITO, for example, the substrate sheet 14 may be formed of a transparent resin, so that an electroluminescent light-emitting device having these transparent electrodes and substrate sheet emits light from both of its front and back surfaces.

The EL light-emitting device 10 may be partly or entirely covered by a suitable protective coating for electrically or mechanically protecting the device.

While the illustrated EL light-emitting device 10 is a generally rectangular plate having straight edges, the EL light-emitting device according to the present invention may have a generally circular or elliptical shape having a curved edge or outer profile.

It is to be understood that the present invention may be embodied with various other changes, modifications and improvements which may occur to those skilled in the art, without departing from the spirit and scope of the present invention defined in the appended claims.

What is claimed is:

1. An electroluminescent light-emitting device having a light-emitting surface area, comprising:

an electroluminescent light-emitting layer containing an electroluminescent material;

an electrode layer formed on one of opposite sides of said electroluminescent light-emitting layer, and including a first electrode and a second electrode which are formed in respective predetermined patterns and spaced apart from each other by spacing regions provided therebetween, in a direction parallel to a plane of said electrode layer, said first and second electrodes being electrically insulated from each other by said spacing regions;

an exposed surface which is located on the other of said opposite sides of said electroluminescent light-emitting layer; and an electrically conductive ink placed on to said exposed surface for emitting a light from a portion of said electroluminescent light-emitting layer which is located below said electrically conductive ink.

2. An electroluminescent light-emitting device according to claim 1, further comprising a top coating which covers one of opposite surfaces of said electroluminescent light-emitting layer which is remote from said electrode layer, said top coating having said exposed surface.

3. An electroluminescent light-emitting device according to claim 2, wherein a surface area of said spacing regions per unit area of said light-emitting, surface area is substantially constant throughout said light-emitting surface area.

4. An electroluminescent light-emitting device according to claim 2, wherein said electroluminescent light-emitting layer has a thickness within a range of 20–50 $\mu$m.

5. An electroluminescent light-emitting device according to claim 2, further comprising an electrically insulating reflecting layer which is interposed between said electroluminescent light-emitting layer and said electrode layer, to reflect light emitted by said electroluminescent light-emitting layer, back toward said electroluminescent light-emitting layer.

6. An electroluminescent light-emitting device according to claim 5, wherein said electrically insulating reflecting layer is formed of a mixture of a power of a ferroelectric material and a resin binder in which said powder is dispersed.

7. An electroluminescent light-emitting device according to claim 5, wherein said electrically insulating reflecting layer has a dielectric constant within a range of 30–100.

8. An electroluminescent light-emitting device according to claim 2, wherein said top coating is formed of a synthetic resin capable of preventing permeation of said electrically conductive ink into said electroluminescent light-emitting layer.

9. An electroluminescent light-emitting device according to claim 8, wherein said top coating is formed of a fluorine-containing synthetic resin.

10. An electroluminescent light-emitting device according to claim 1, further comprising a substrate on which said electrode layer is formed.

11. An electroluminescent light-emitting device according to claim 10, wherein said substrate is a transparent sheet of a synthetic resin.

12. An electroluminescent light-emitting device according to claim 11, wherein said first and second electrodes of said electrode layer are transparent electrodes.

13. An electroluminescent light-emitting device according to claim 12, wherein said transparent electrodes are formed of indium tin oxide.

14. An electroluminescent light-emitting device according to claim 1, wherein said electrically conductive ink is capable of transmitting light.

15. An electroluminescent light-emitting device according to claim 1, wherein said first and second electrodes consist of transparent layers.

* * * * *